US006019628A

United States Patent [19]

Shinchi

[11] Patent Number: 6,019,628

[45] Date of Patent: Feb. 1, 2000

[54] ELECTRIC-WIRE CONNECTION STRUCTURE OF CONNECTOR

[75] Inventor: Akira Shinchi, Shizuoka-ken, Japan

[73] Assignee: Yazaki Corporation, Tokyo, Japan

[21] Appl. No.: 08/992,093

[22] Filed: Dec. 17, 1997

[30] Foreign Application Priority Data

Dec. 26, 1996 [JP] Japan ..... 8-348240

[51] Int. Cl.[7] ..... H01R 13/58

[52] U.S. Cl. ..... 439/465; 439/942

[58] Field of Search ..... 439/358, 465, 439/466, 467, 460, 942; 29/872; 73/46

[56] References Cited

U.S. PATENT DOCUMENTS 5,664,961 9/1997 Tsuji et al. ..... 439/358

FOREIGN PATENT DOCUMENTS 7-70345 7/1995 Japan .

*Primary Examiner*—Michael L. Gellner
*Assistant Examiner*—Antoine Ngandjui
*Attorney, Agent, or Firm*—Finnegan, Henderson, Farabow, Garrett & Dunner, L.L.P.

[57] ABSTRACT

A covered electric wire is placed on a conductor drawn out onto a terminal retaining portion protruding from an end portion of a connector housing. A a core wire of the covered electric wire is conductively contacted with the conductor and welding ribs on both sides of a cover closing the terminal retaining portion are welded to the terminal retaining portion by oscillating ultrasonic waves while pressing the covered electric wire against the conductor by means of this cover. On an outer periphery of the cover there is formed a reinforcing rib covering the length between the welding ribs on both sides thereof.

4 Claims, 8 Drawing Sheets

ELECTRIC-WIRE CONNECTION STRUCTURE OF CONNECTOR

BACKGROUND OF THE INVENTION

1. Field of the Invention

The present invention relates to an electric-wire connection structure of a connector and, more particularly, to an electric-wire connection structure of a connector which is arranged to connect a conductor constituting a terminal of the connector and a covered electric wire by the use of ultrasonic wave oscillation.

2. Description of Relevant Art

FIGS. 1A and 1B and FIG. 2 show a conventional example of an electric-wire connection structure of a connector (see Japanese Patent Publication No. 7-70345).

The electric-wire connection structure shown in FIGS. 1A and 1B is equipped with a first member 23 having groove portions 22 formed therein and a second member 25 having convex portions 24 formed thereon, whereby a lead wire 26 and a contact member 27 are laminated in the groove portion 22 and the convex portion 24 is applied from above onto the resulting laminate in such a way as to clamp the resulting laminate between the convex portion 24 and the groove portion 22, whereby the first member 23 and the second member 25 are welded together by the use of ultrasonic vibration.

In the electric-wire connection structure shown in FIGS. 1A and 1B and FIG. 2, a plurality of the lead wires 26 and a plurality of the contact members 27 are clamped by and between the first member 23 and the second member 25, which are formed with a plurality of the groove portions 22 and a plurality of the convex portions 24, respectively, and are welded together.

FIGS. 3 and 4 show an applied example of the above-described connection structure based on the use of ultrasonic welding to an actual connector. Namely, a cover 7 (corresponding to the above-described second member 25) is welded onto a terminal retaining portion 3 (corresponding to the above-described first member 23) protruding from a front portion of a connector housing 2 by ultrasonic oscillation. At this time, the cover 7 and the terminal retaining portion 3 are ultrasonically welded to each other with a covered electric wire 17 (corresponding to the above-described lead wire 26) and a conductor 16 (see FIG. 3) drawn out from the connector housing 2 being clamped therebetween.

Within the connector housing 2, there is generally formed a projection 14 for holding interfitting between male and female connectors. In order to form this projection 14, as shown in FIG. 7, on a first mold 28 for forming the connector housing 2 there is disposed a second mold 29 for shaping the projection 14. After shaping thereof, the second mold 29 is drawn out in the forward direction. For this reason, a mold drawout hole 15 is made open at the front surface of the connector housing 2.

In a case where the connection structure such as that shown in FIGS. 1A and 1B has been applied to an actual connector such as that shown in FIG. 4, the following problems arise.

First, as shown in FIG. 3, when an outermost side welding rib 10 is welded to the terminal retaining portion 3 both by ultrasonic vibration and by pressurizing force, the welding rib 10 is flexed to outside the structure, with the result that there is the likelihood of the welding rib 10 being deformed or broken.

Further, as the mold drawout hole 15 is left open, there is the likelihood that metal pieces will enter from this hole and in the worst case a connector terminal will be shortcircuited thereby.

Furthermore, there may be also a case where the terminal retaining portion 3 and the cover 7 are displaced from each other due to the ultrasonic vibration (this is particularly the case when the size of the covered electric wire 17 differs as shown in FIGS. 5A and 5B) with the result that a portion where no conduction can be made is produced (see FIG. 5B). To prevent this, there is also a method which ultrasonically welds the terminal retaining portion 3 and the cover 7 in a state where these members are positioned using a jig 30 as shown in FIG. 6. However, in this method, the mounting and demounting of the jig 30 are complex and further interference of it with ultrasonic waves is also likely to occur. Therefore, this method is not practical.

SUMMARY OF THE INVENTION

The present invention has been achieved with such points in view.

It therefore is an object of the present invention to provide an electric-wire connection structure of a connector which is arranged to prevent deformation and breakage of the welding rib and enable the closure of the mold drawout hole.

To achieve the object, a first aspect of the invention provides an electric-wire connection structure of a connector wherein the covered electric wire is placed on the conductor drawn out into the groove portion of the terminal retaining portion caused to protrude from an end portion of the connector housing; and by causing ultrasonic oscillation while the covered electric wire is being pressed against the conductor by means of the convex portion provided on the cover closing the terminal retaining portion and fitted into the groove portion, the core wire of the covered electric wire is conductively contacted with the conductor and the cover is welded to the terminal retaining portion, the cover having welding ribs formed on both side portions thereof and fitted into welding concave portions of the terminal retaining portion and welded to this terminal retaining portion and having a reinforcing rib formed on an outer periphery thereof and covering the length between the welding ribs of both sides thereof.

According to the first aspect, a conductor is disposed in a terminal retaining portion and a covered electric wire is superposed on this conductor. And a cover is placed on the terminal retaining portion and a welding rib is fitted into a welding concave portion of the terminal retaining portion. And the cover and the terminal retaining portion are welded to each other by ultrasonic oscillation and on the other hand a covering portion of the covered electric wire is molten and removed to thereby connect a core wire and the conductor. Even when a force causing the deformation of the welding rib in the outward direction acts thereon, the exertion of such force is inhibited by a reinforcing rib, the welding rib is prevented from being deformed or broken.

Accordingly, as the reinforcing rib is formed along the outer periphery of the cover and in such a way as to cover the length between the welding ribs of both sides thereof, even when a force causing the deformation of the welding rib in the outward direction acts thereon, the exertion of such force is inhibited by the reinforcing rib, whereby the welding rib is prevented from being deformed or broken to ensure ultrasonic welding.

A second aspect of the invention provides an electric-wire connection structure of a connector, wherein the reinforcing rib is formed at the end portion on the connector housing side of the cover and is so formed that the reinforcing rib may have a height which, when mounting the cover, permits the reinforcing rib to abut on a front wall of the connector housing and close a mold drawout hole formed in the front wall thereof.

According to the second aspect, a reinforcing rib serves to hide a mold drawout hole by being caused to abut on the front surface of a connector housing, with the result that foreign substances are prevented from entering by way of the mold drawout hole.

A third aspect of the invention depending from the first or the second aspect provides an electric-wire connection structure of a connector, wherein with respect to the terminal retaining portion there are alternately formed the groove portion in which the conductor and the covered electric wire are laminated one over the other and the convex portion; with respect to the cover there are formed convex portions and groove portions which are respectively fitted with respect to the groove portions and the convex portions of the terminal retaining portions; and the welding rib has a protruding height greater than the height of the convex portion of the cover and is formed with a taper surface on at least an inner side of a forward end thereof.

According to the third aspect, even when the diameter of a covered electric wire is different or even when a force acts in a direction in which a cover is displaced due to the vibration resulting from the ultrasonic oscillation, the cover is prevented from being disengaged from the terminal retaining portion by engagement between a taper surface and a convex portion.

Accordingly, as the taper surface at which when the cover has been obliquely set the cover is engaged with the convex portion of the terminal retaining portion is formed on the inner side of the welding rib, even when the diameter of the covered electric wire is different or even when a force acts in the direction in which the cover is displaced due to the vibration resulting from the ultrasonic oscillation, the cover is prevented from being disengaged from the terminal retaining portion by engagement between the taper surface and the convex portion.

A fourth aspect of the invention depending from the first, the second or the third aspect provides an electric-wire connection structure of a connector, wherein at an intermediate portion of the convex portion of the cover there is formed a notched portion which permits escapement thereinto of a removed covering portion of the covered electric wire.

According to the fourth aspect, a covering portion removed from a covered electric wire by ultrasonic oscillation is escaped into a notched portion, with the result that a core wire and a conductor are conductively contacted with each other reliably.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

The contents of U.S. Pat. No. 5,584,122 are incorporated herein by reference.

There will be detailed below the preferred embodiments of the present invention with reference to the accompanying drawings. It is to be noted that members which are the same as those in FIG. 3 through FIGS. 5A and 5B are designated by like reference numbers.

Figure 8:
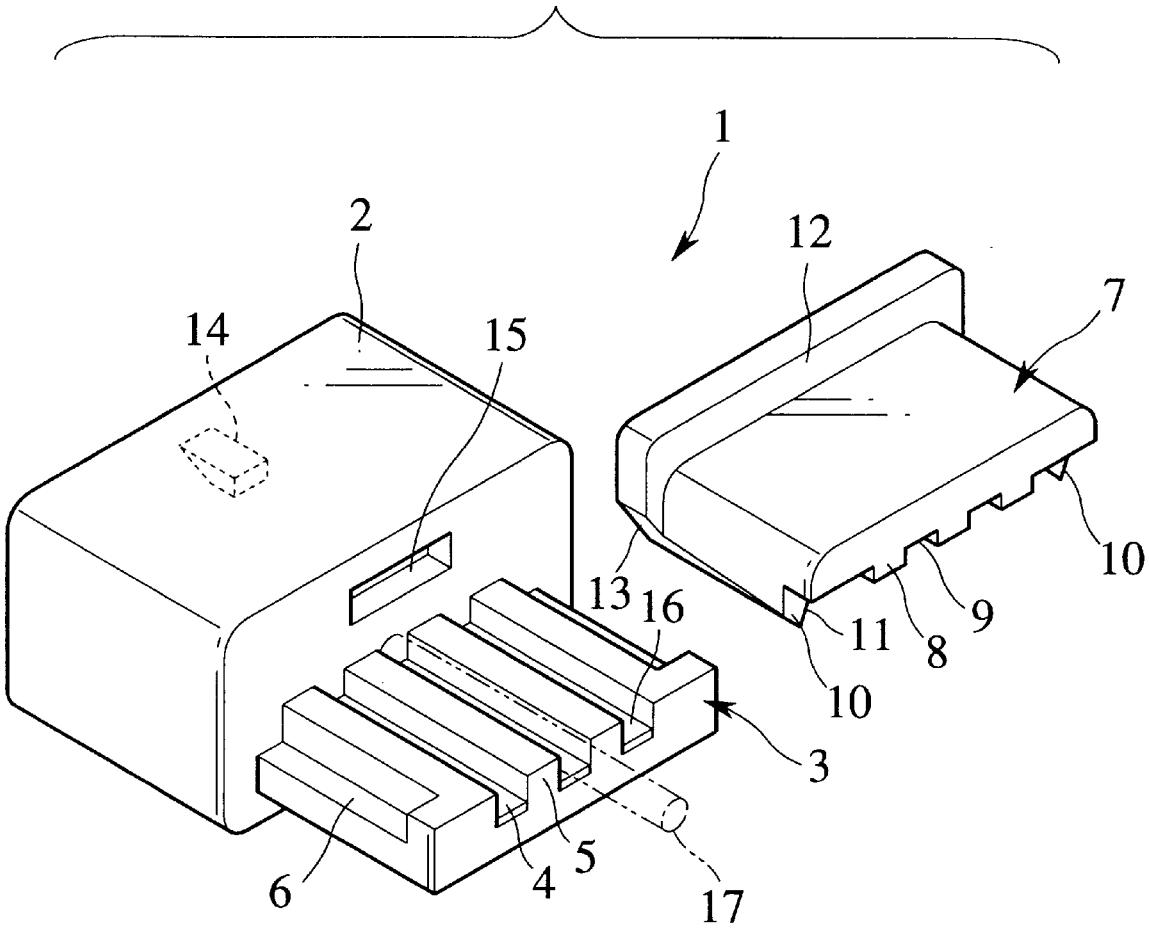
FIG. 8 is a perspective view of a manufacturing step of an electric-wire connection structure of a connector according a first embodiment of the present invention.

In FIG. 8, on a front portion of a connector housing 2 there is integrally formed a terminal retaining portion 3, the resulting structure as a whole being made of plastic. The interior of the connector housing 2 has a projection 14 which has been formed by a mold in the above-described way and in a front portion of the connector housing there is formed a mold drawout hole 15.

With respect to an upper surface of the terminal retaining portion 3 there are alternately formed groove portions 4 and convex portions 5 and, with respect to the outermost sides thereof, there are formed concave portions 6.

With respect to an underside of a cover 7 there are alternately formed convex portions 8 and groove portions 9 corresponding to the groove portions 4 and the convex portions 5, and at intermediate positions of the convex portions 8 there are formed notched portion 18 (see FIG. 10 as later described). With respect to the outermost sides of the cover 7, there are formed welding ribs 10 corresponding to welding concave portions 6. This welding rib 10 has a forward end which is formed with taper surfaces 11 and thereby formed into a projection like configuration to thereby cause concentrated application of ultrasonic waves.

At the outer periphery of a rear portion of the cover 7 there is integrally formed a reinforcing rib 12. Left and right portions of the reinforcing rib 12 protrude outwardly from the welding ribs 10 and 10, and with respect to lower portions thereof there are formed taper surfaces 13 which are flush with the corresponding taper surface of the welding rib 10.

Next, a connection step of connecting a covered electric wire 17 and the connector housing 2 will be explained.

In the groove portion 4 of the terminal retaining portion 3 there is disposed a conductor 16 which has been integrated with or connected to a contact portion (not shown) within the housing 2. The covered electric wire 17 is superposed on this conductor 16. Next, the cover 7 is placed on the terminal retaining portion 3 with correspondence of the convex portion 8 and the groove portion 9 to the groove portion 4 and the convex portion 5 of the terminal retaining portion 3, whereby the welding rib 10 is fitted into the welding concave portion 6 along with the reinforcing rib 12.

Figure 9A:
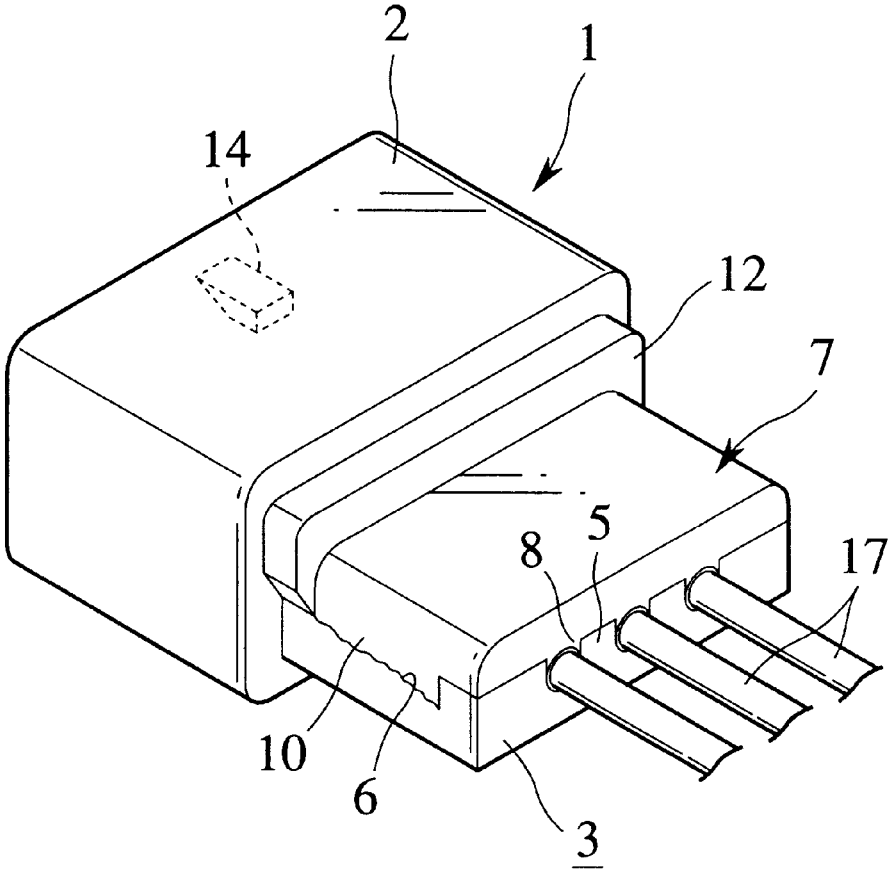
FIG. 9A is a perspective view, after completed, of the electric-wire connection structure of the connector according to the first embodiment of the present invention
Figure 9B:
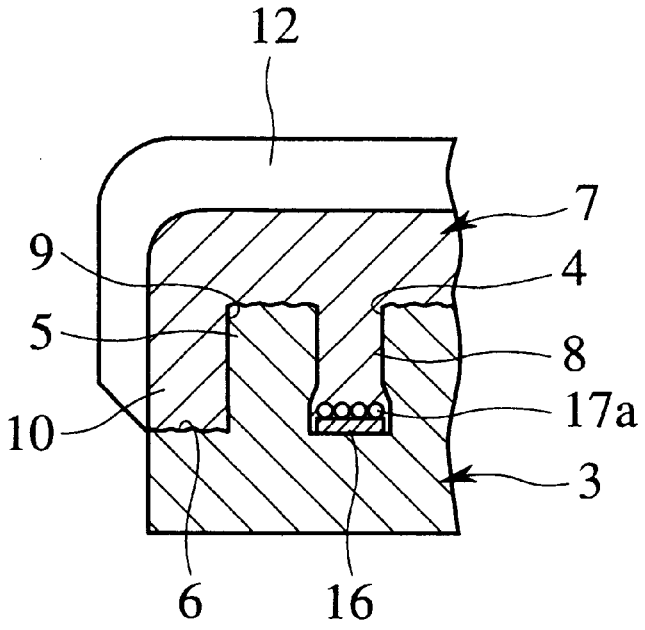
FIG. 9B is a partial section of a complete product thereof.

In this state, an ultrasonic horn (not shown) is applied onto the cover 7, thereafter to oscillate ultrasonic waves while a load is being applied to the cover 7. As a result of this, the welding rib 10 is welded to the welding concave portion 6 of the terminal retaining portion 3 and a covering portion of the covered electric wire 17 is molten and removed by the vibration of the convex portion 8 of the cover 7 and this removed covering portion escapes into the notched portion 18, whereby a core wire is conductively connected to the conductor 16. When the cover 7 is further lowered due to the load applied, the groove portions 4 and the convex portions 5 of the terminal retaining portion 3 are respectively welded to the convex portions 8 and the groove portions 9 of the cover 7, with the result that a connector 1 such as that shown in FIG. 9A is completed. At this time, the core wire 17*a* and the conductor are fixed by the convex portion 8 whose forward end is welded to the groove portion 4 as shown in FIG. 9B, and thereby are maintained to be in a conductively contacted state. It is to be noted that in FIG. 9B a wave line portion indicates a welded state.

Figure 1A:
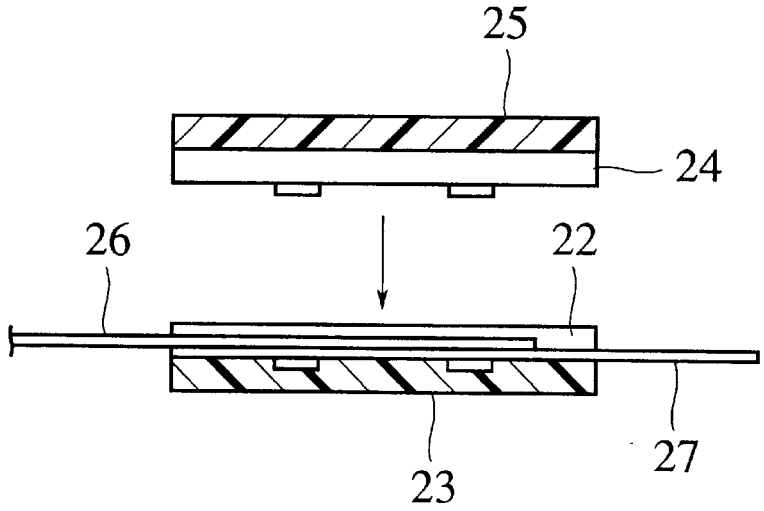
FIG.1A PRIOR ART
FIGS. 1A and 1B show a conventional electric-wire connection structure of a connector, FIG. 1A being a longitudinal side view and FIG. 1B being a right side view.
Figure 1B:
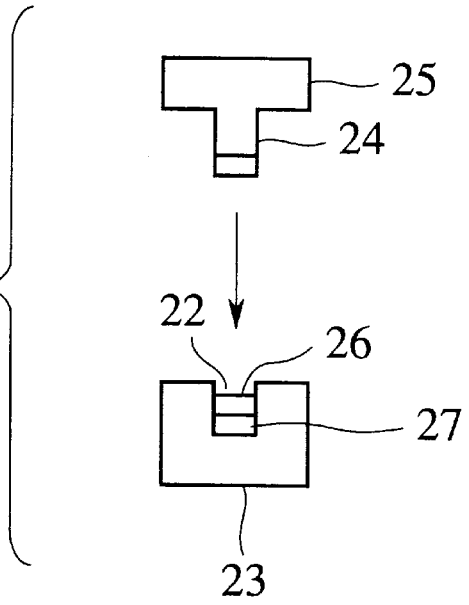
FIG.1B PRIOR ART
Figure 2:
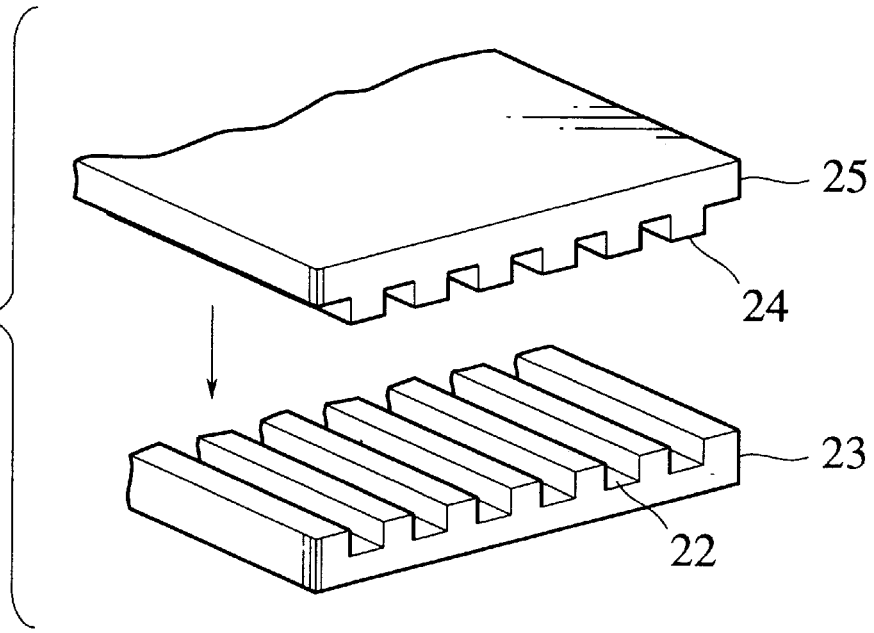
FIG.2 PRIOR ART
FIG. 2 is a perspective view of a conventional electric-wire connection structure of a connector.
Figure 3:
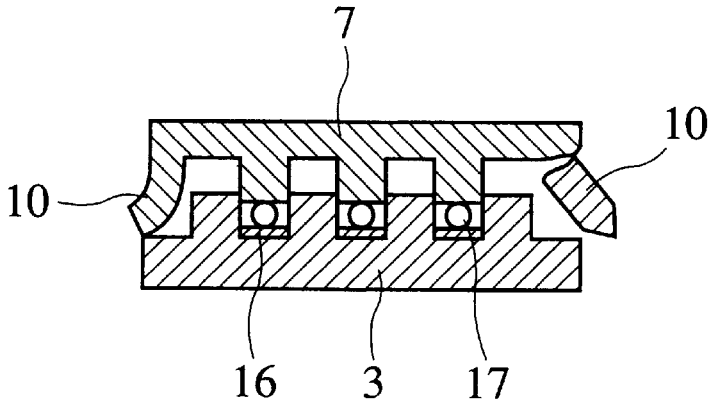
FIG.3 PRIOR ART
FIG. 3 is a section showing the function of the conventional electric-wire connection structure of the connector.
Figure 4:
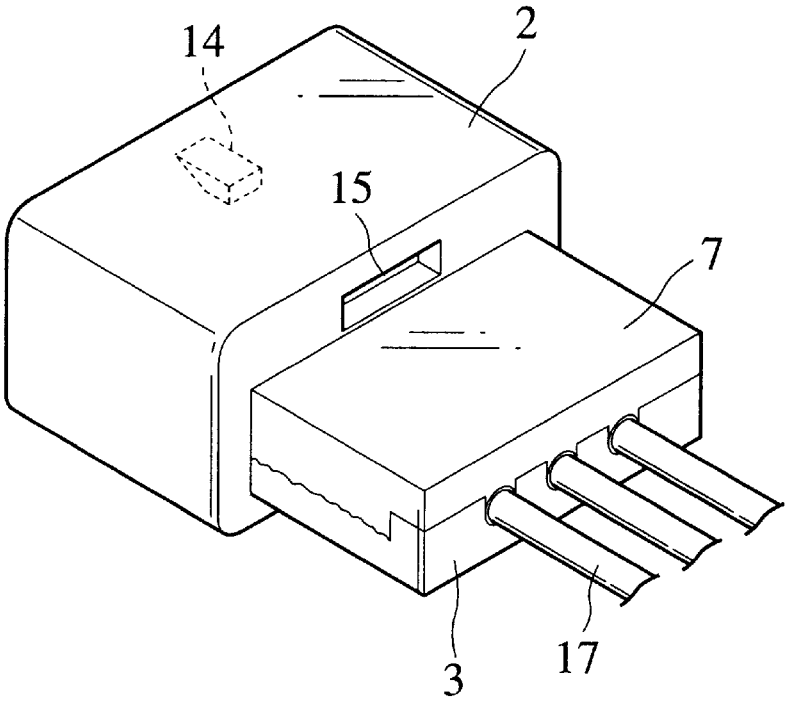
FIG.4 PRIOR ART
FIG. 4 is a perspective view of a connector equipped with a conventional electric-wire connection structure.
Figure 5A:
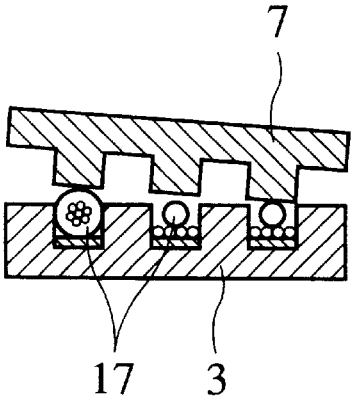
FIG.5A PRIOR ART
FIGS. 5A and 5B are each a section showing the function of the conventional electric-wire connection structure of a connector, FIG. 5A being the section before welding and FIG. 5B being the section after welding.
Figure 5B:
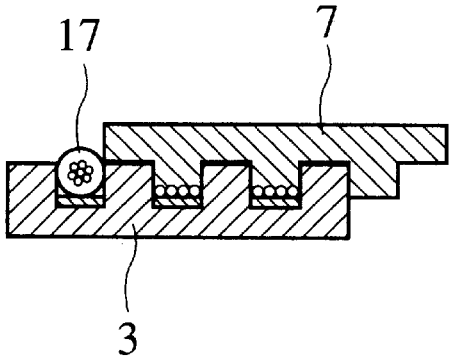
FIG.5B PRIOR ART
Figure 6:
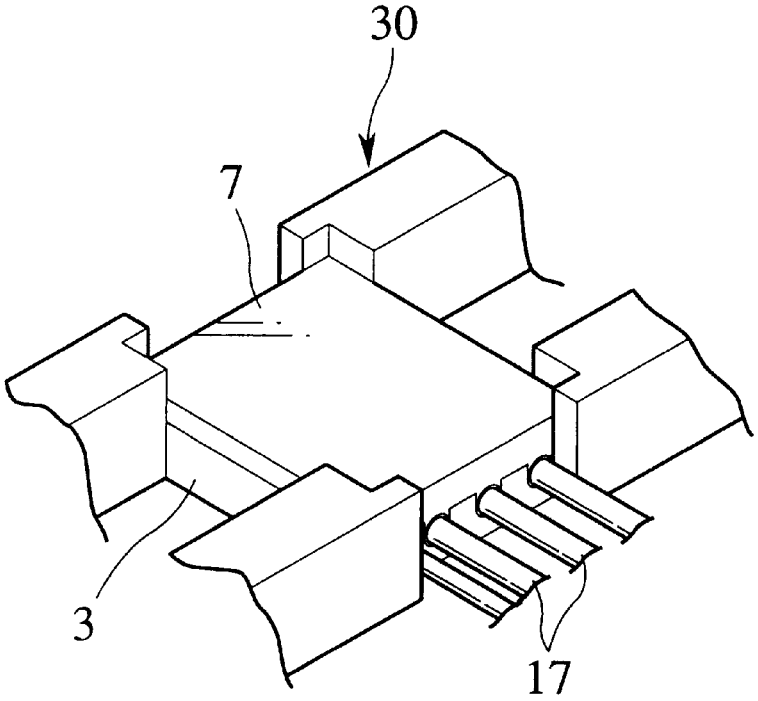
FIG.6 PRIOR ART
FIG. 6 is a perspective view of a manufactured example of the conventional electric-wire connection structure of the connector.
Figure 7:
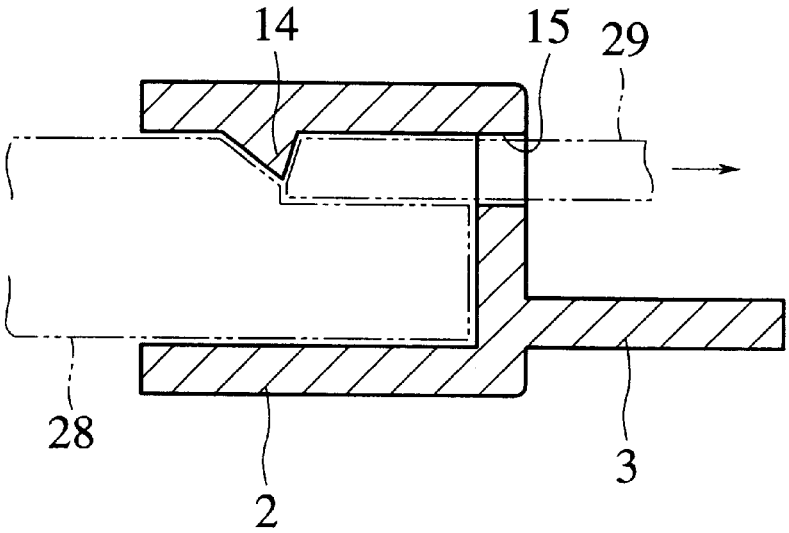
FIG.7 PRIOR ART
FIG. 7 is a section of a molding step of a conventional connector housing.

In this embodiment, the connector 1 has the reinforcing rib 12. Therefore, even when a force causing the deformation of the welding rib 10 in the outward direction acts thereon, the exertion of such force is inhibited, whereby the welding rib is prevented from undergoing such deformation and breakage as shown in FIG. 3.

Also, the reinforcing rib 12 serves to hide the mold drawout hole 15 by being caused to abut on the front surface of the connector housing 2, with the result that foreign substances are prevented from entering by way of the mold drawout hole 15.

It is to be noted that in a case where there is no necessity to close the mold drawout hole 15, there is no need to form the reinforcing rib 12 at the rear portion of the cover 7 as in the case of this embodiment and the reinforcing rib 12 may be formed on a given portion of the outer periphery of the cover 7.

Figure 10:
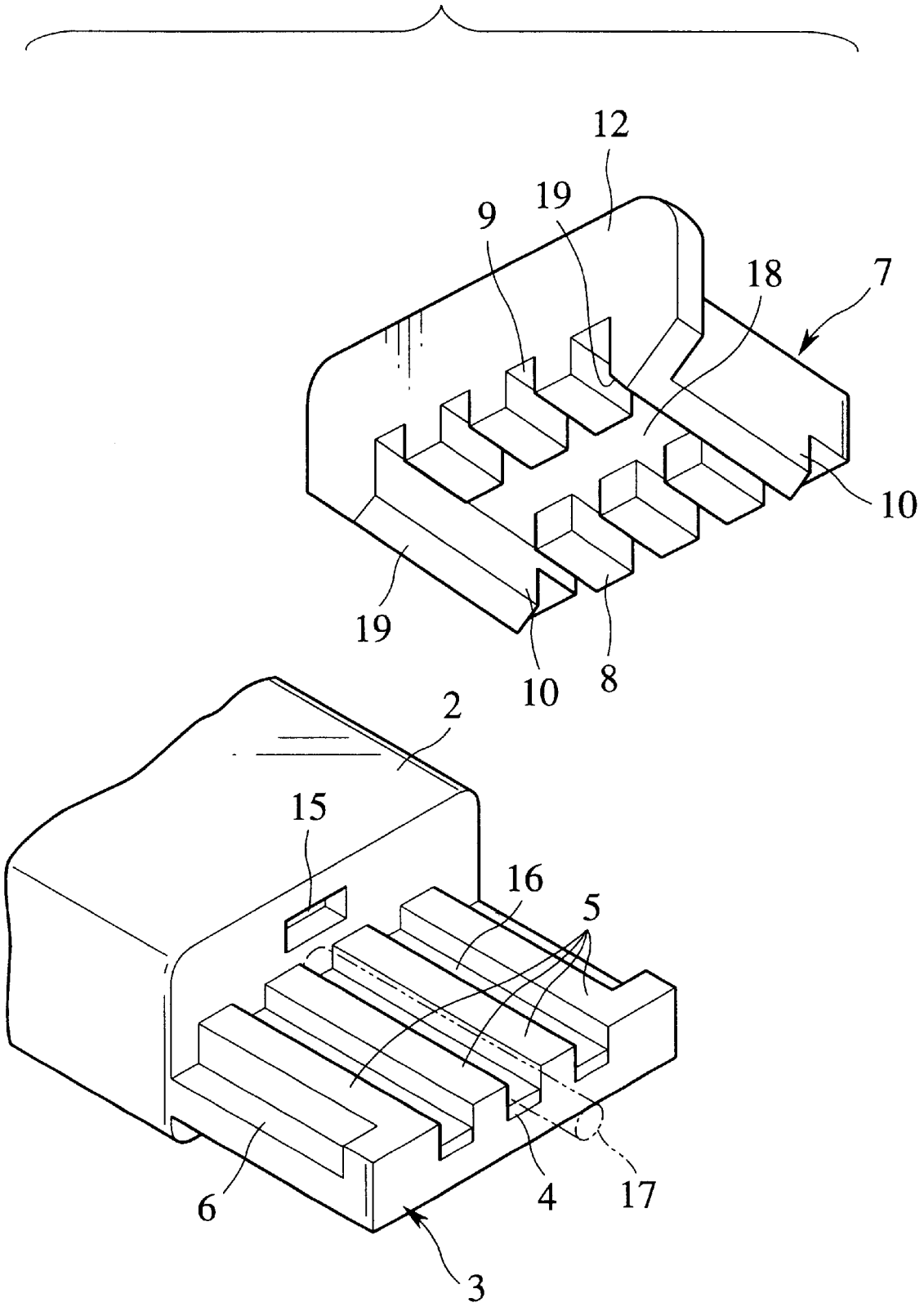
FIG. 10 is a perspective view of a manufacturing step of an electric-wire connection structure of a connector according to a second embodiment of the present invention.
Figure 11:
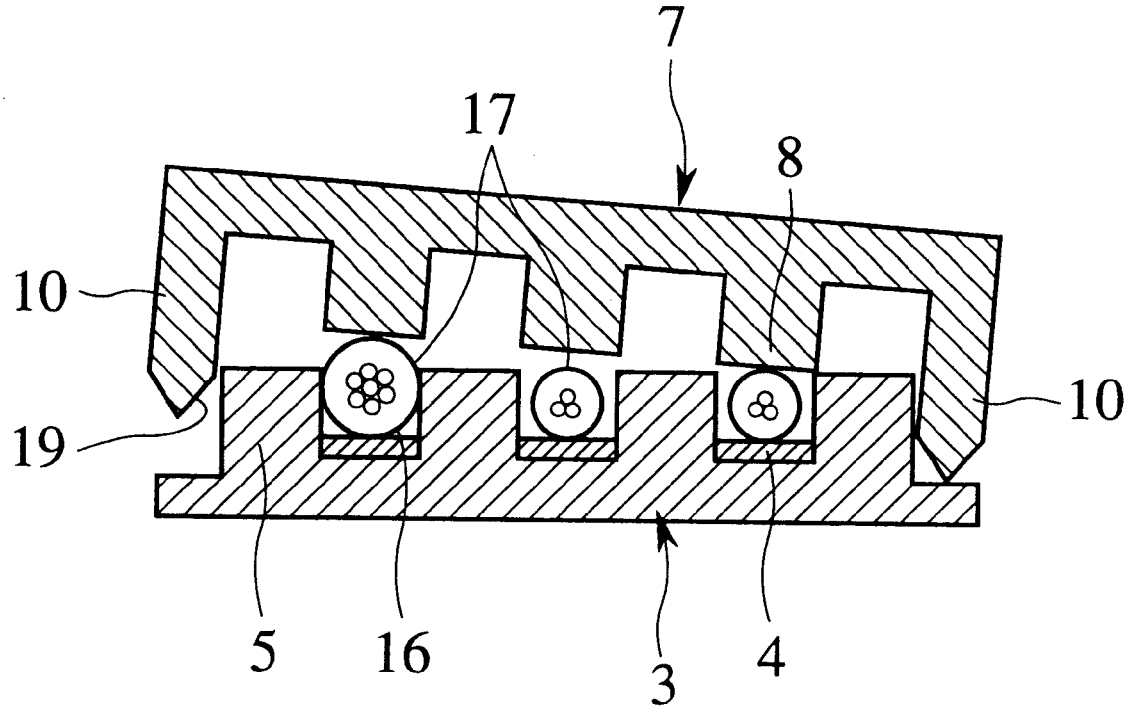
FIG. 11 is a section of a main part of the manufacturing step of the second embodiment.

FIGS. 10 and 11 show a second embodiment of the present invention, in which contrivance is so made as to cope with the covered electric wires of different diameters.

In FIG. 10, a connector housing 2 is the same as that in the case of the first embodiment. The second embodiment is the same as the first embodiment also in that a cover 7 is formed with convex portions 8 and groove portions 9 and each of these convex portions 8 is formed with a notched portion 18 and a reinforcing rib 12 is formed at a rear outer periphery of the cover 7.

In the second embodiment, the protruding height of a welding rib 10 is made larger than the height of the convex portion 8 and on an inner side of a forward end of the welding rib 10 there is formed an inside taper surface 19 of a structure such as that shown in FIG. 11. Namely, in FIG. 11, when the cover 7 is placed obliquely with respect to a terminal retaining portion 3, the inside taper surface 19 of the welding rib 10 (the left side of FIG. 11) located at an oblique upper position abuts against an angular portion of an outermost side convex portion 5 and is thereby brought into engagement therewith. As a result of this, even when vibrations are applied from above by means of a ultrasonic horn, the cover 7 becomes not disengaged from the terminal retaining portion 3, with the result that even in the case of connecting a covered electric wire 17 of a different diameter as in FIG. 11, the cover 7 is not disengaged with the result that stable connection becomes possible.

While preferred embodiments of the present invention have been described using specific terms, such description is for illustrative purposes, and it is to be understood that changes and variations may be made without departing from the spirit or scope of the following claims.

What is claimed is:

1. An electric-wire connection structure of a connector comprising:

a connector housing;

a terminal retaining portion protruding from an end portion of the connector housing;

a groove portion provided in the terminal retaining portion;

a conductor drawn out into the groove portion;

a covered electric wire placed on the conductor;

a cover closing the terminal retaining portion wherein said cover has side portions; and a convex portion provided on the cover and fitted into the groove portion, wherein the covered electric wire is pressed against the conductor by means of the cover, a core wire of the covered electric wire and the conductor are conductively contacted with each other, and the cover is welded to the terminal retaining portion; and the cover has welding ribs provided on the side portions thereof and fitted into welding concave portions of the terminal retaining portion and welded to this terminal retaining portion and has a reinforcing rib provided on an outer periphery thereof and covering the length between the welding ribs of the sides thereof.

2. An electric-wire connection structure of a connector according to claim 1, wherein the reinforcing rib is formed at the end portion on the connector housing side of the cover and is formed to have a height permitting the reinforcing rib to abut on a front wall of the connector housing and to close a mold drawout hole formed in the front wall thereof when the cover is mounted to the connector housing.

3. An electric-wire connection structure of a connector according to claim 1, wherein the terminal retaining portion is alternately formed with the groove portion in which the conductor and the covered electric wire are laminated one over the other and the convex portion;

the cover is formed with convex portions and groove portions which are respectively fitted with the groove portions and the convex portions of the terminal retaining portions; and the welding ribs have a protruding height greater than the height of the convex portion of the cover and are formed with a taper surface on at least an inner side of a forward end thereof.

4. An electric-wire connection structure of a connector according to one of claim 1, wherein an intermediate portion of the convex portion of the cover is formed with a notched portion permitting escapement thereinto of a removed covering portion of the covered electric wire.

* * * * *

UNITED STATES PATENT AND TRADEMARK OFFICE

CERTIFICATE OF CORRECTION

PATENT NO. : 6,019,628
DATED : February 1, 2000
INVENTOR(S) : Akira SHINICHI

It is certified that error appears in the above-identified patent and that said Letters Patent is hereby corrected as shown below:

Title Page, Item [57], in the Abstract, line 3, before "core", delete "a".

Claim 4, column 6, line 55, before "claim 1", delete "one of".

Signed and Sealed this

Tenth Day of April, 2001

*Attest:*

Nicholas P. Godici

NICHOLAS P. GODICI

*Attesting Officer*

*Acting Director of the United States Patent and Trademark Office*